US009357292B2

(12) United States Patent
Huang et al.

(10) Patent No.: US 9,357,292 B2
(45) Date of Patent: May 31, 2016

(54) IMPLEMENTATION OF MICROPHONE ARRAY HOUSING RECEIVING SOUND VIA GUIDE TUBE

(71) Applicant: Fortemedia, Inc., Sunnyvale, CA (US)

(72) Inventors: Yen-Son Paul Huang, Los Altos Hills, CA (US); Iou-Din Jean Chen, San Jose, CA (US); James Juei Son Lin, Sunnyvale, CA (US)

(73) Assignee: FORTEMEDIA, INC., Sunnyvale, CA (US)

( * ) Notice: Subject to any disclaimer, the term of this patent is extended or adjusted under 35 U.S.C. 154(b) by 201 days.

(21) Appl. No.: 13/834,658

(22) Filed: Mar. 15, 2013

(65) Prior Publication Data

US 2014/0161295 A1 Jun. 12, 2014

Related U.S. Application Data

(60) Provisional application No. 61/734,035, filed on Dec. 6, 2012.

(51) Int. Cl.
*H04R 1/40* (2006.01)
*H04R 1/34* (2006.01)

(52) U.S. Cl.
CPC ..... *H04R 1/406* (2013.01); *H04R 1/342* (2013.01)

(58) Field of Classification Search
CPC ..... H04R 2499/11; H04R 1/02; H04R 1/08; H04R 1/34; H04R 1/342; H04R 1/40; H04R 1/406; H04R 1/326
USPC ..... 381/355, 357, 360, 361, 365–366
See application file for complete search history.

(56) References Cited

U.S. PATENT DOCUMENTS 5,121,426 A * 6/1992 Baumhauer, Jr. ..... H04M 1/20 379/388.02
5,526,430 A * 6/1996 Ono ..... H04R 1/406 381/26
5,539,834 A * 7/1996 Bartlett ..... H04M 1/19 381/170
5,745,588 A * 4/1998 Bartlett ..... H04R 1/2869 381/170
6,151,399 A * 11/2000 Killion ..... H04R 1/38 381/313

(Continued)

OTHER PUBLICATIONS

The Office Action issued in U.S. Appl. No. 13/901,081 on Jul. 2, 2014.

*Primary Examiner* — Davetta W Goins
*Assistant Examiner* — Jasmine Pritchard
(74) *Attorney, Agent, or Firm* — McClure, Qualey & Rodack, LLP

(57) ABSTRACT

An electronic device is provided. The electronic device includes a case, an acoustic boot, a first microphone and a second microphone. The case includes a first acoustic opening, a second acoustic opening. The acoustic boot comprises a first duct and a second duct, the first duct is connected to the first acoustic opening, and the second duct is connected to the second acoustic opening. The first microphone is connected to the first duct. The second microphone is connected to the second duct.

16 Claims, 9 Drawing Sheets

(56) References Cited

U.S. PATENT DOCUMENTS 8,036,412 B2 * 10/2011 Kaderavek ..... H04R 1/38 381/355
8,472,639 B2 * 6/2013 Reining ..... H04R 1/38 381/122
8,861,764 B2 * 10/2014 Tanaka ..... H04R 1/38 381/355
8,879,767 B2 * 11/2014 Wickstrom ..... H04R 19/04 381/174
2002/0110255 A1 * 8/2002 Killion ..... H04R 1/083 381/356
2004/0247146 A1 * 12/2004 Killion ..... H04R 1/083 381/312
2007/0127759 A1 * 6/2007 Zhang ..... H04R 1/342 381/338
2008/0013770 A1 * 1/2008 Wu ..... H04R 1/406 381/357
2008/0069389 A1 * 3/2008 Zhang ..... H04R 1/406 381/355
2014/0079269 A1 * 3/2014 Choi ..... H04R 1/04 381/365

* cited by examiner

IMPLEMENTATION OF MICROPHONE ARRAY HOUSING RECEIVING SOUND VIA GUIDE TUBE

CROSS REFERENCE TO RELATED APPLICATIONS

This application claims the benefit of U.S. Provisional Application No. 61/734,035, filed Dec. 6, 2012, the entirety of which is incorporated by reference herein.

BACKGROUND OF THE INVENTION

1. Field of the Invention

Two Inventions:

The present invention relates to acoustic boot served as guide tube which insert between an electronic device with plural acoustic openings on its case and microphone array disposed in housing inside the electronic device.

The design of microphone array housing to fit the acoustic boot to achieve a better airtight and phase match for the electronic device.

2. Description of the Related Art

Microphone arrays using two or more microphones are getting more and more popular nowadays. Due to more acoustic information received, it can provide better performance compared with conventional single microphone solutions. CMOS-MEMS (Micro-Electro-Mechanical Systems) technology enables Microphone arrays be fabricated in a single chip and single package compatible to the size and pin out of a single MEMS microphone. In this case, the center to center distance between two microphone membrane in housing can be 2 mm or less. But, for SAM (Small Array Microphone) voice processing applications, the minimum distance between the acoustic openings on the device surface is larger than 5 mm. This invention is to extend the distance between two sound inlets of microphone housing to larger distance of two acoustic opening on the device case by acoustic boot inserted in between.

BRIEF SUMMARY OF THE INVENTION

An electronic device is provided. The electronic device with two acoustic openings on its case

- a microphone housing with two extended ducts in an acoustic boot
- Each duct comprises of two sound ports. For first duct, its first sound port is connected to the first acoustic opening, and its second sound port is to the first sound inlet to microphone membrane in housing
- For the second duct, its first sound port is connected to the second acoustic opening, and its second sound port is to the second sound inlet to microphone membrane in housing.

Utilizing the embodiments of the invention, the microphone effective distance can be increased by using different directions of the ducts A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
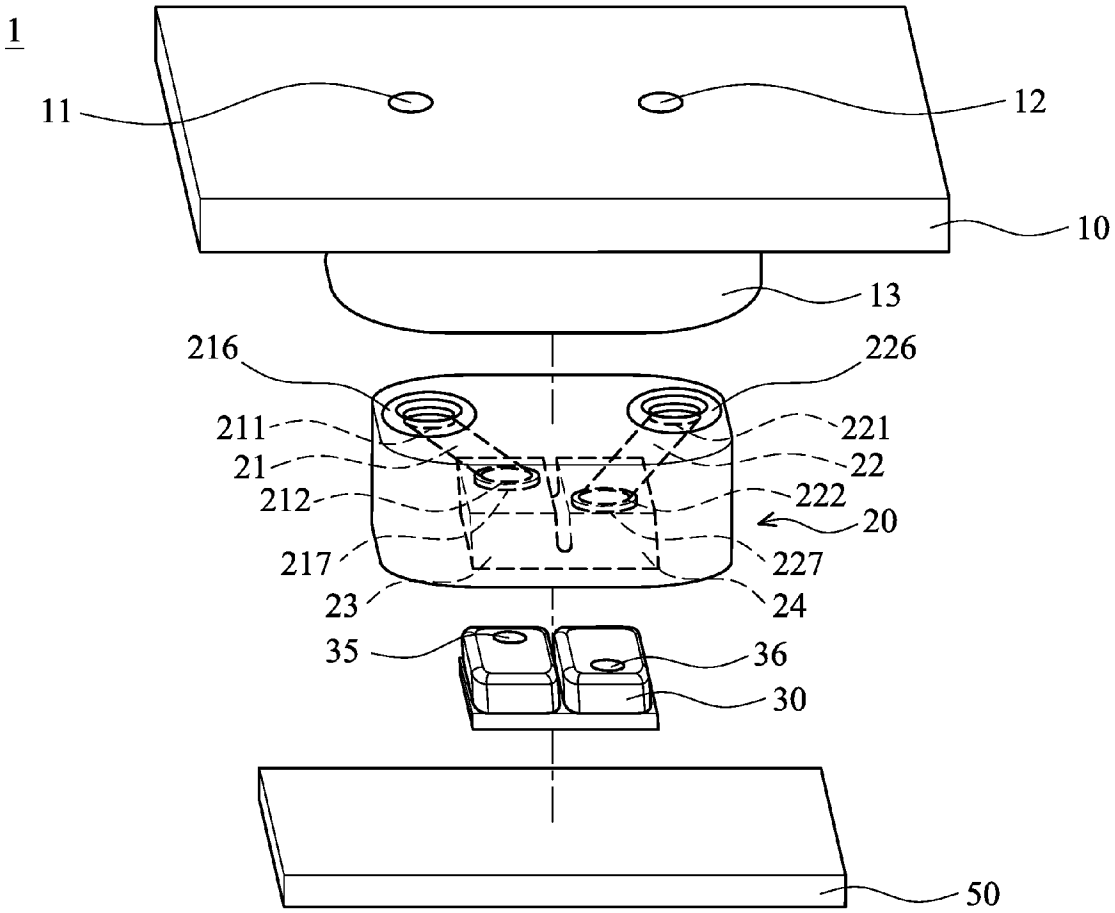
FIG. 1 is a perspective view of the electronic device of the embodiment of the invention.
Figure 2:
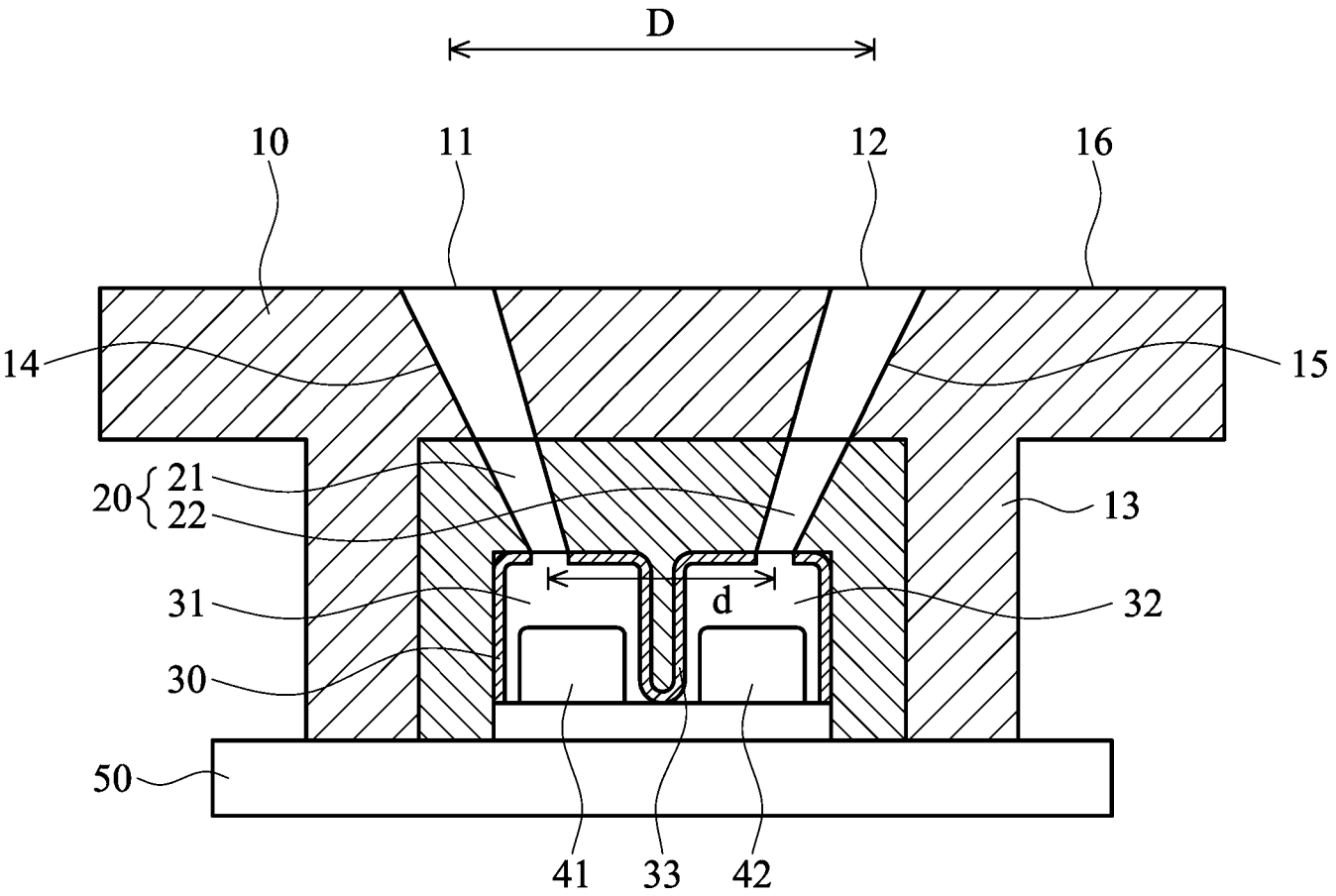
FIG. 2 is a sectional view of the electronic device of the embodiment of the invention.

FIGS. 1 and 2 shows an electronic device 1 of an embodiment of the invention, comprising an electronic device case 10, a microphone housing 30, a first microphone membrane 41, a second microphone membrane 42 and a print circuit board 50. The first microphone membrane 41 and the second microphone membrane 42 are disposed in the housing 30, and are electrically connected to the print circuit board 50. The 10 comprises a first acoustic opening 11, a second acoustic opening 12 and a wedging portion 13. The acoustic boot 20 is wedged to the wedging portion 13, wherein the extended ducts of microphone housing 20 comprises a first duct 21 and a second duct 22, the first duct 21 connecting to the first acoustic opening 11 and first microphone sound inlet 31, and the second duct 22 is connected to the second acoustic opening 12 and second microphone sound inlet 32. With reference to FIG. 2, the first microphone membrane 41 and the second microphone membrane 42 are disposed in the case 30, wherein the first sound inlet 31 is connected to the first duct 21, and the second sound inlet 32 is connected to the second duct 22. The acoustic boot 20 is integrally formed and comprises a first recess 23, a second recess 24.

In the embodiment of the invention, the first and second microphones can be integrated into a Small Array Microphone (SAM) by MEMS technology.

Figure 7A:
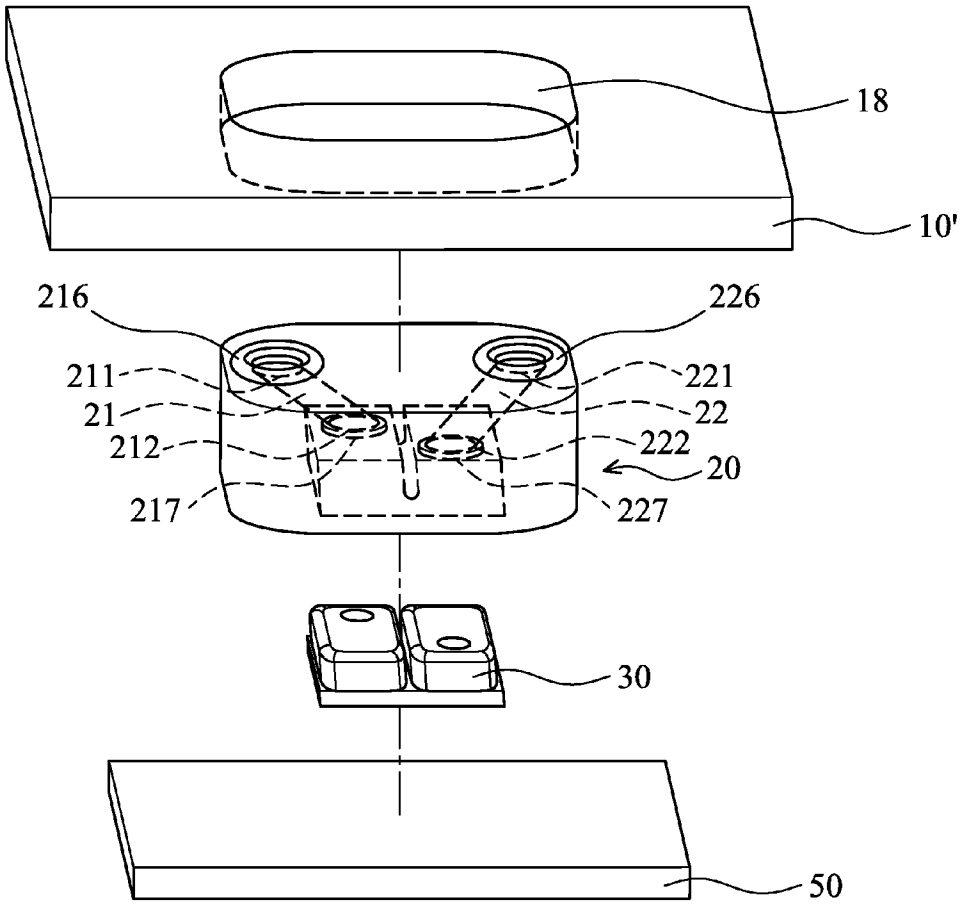
FIGS. 7A, 7B show the modified example of the invention, wherein the extended duct is detachably inserted into a through hole of the case.
Figure 7B:
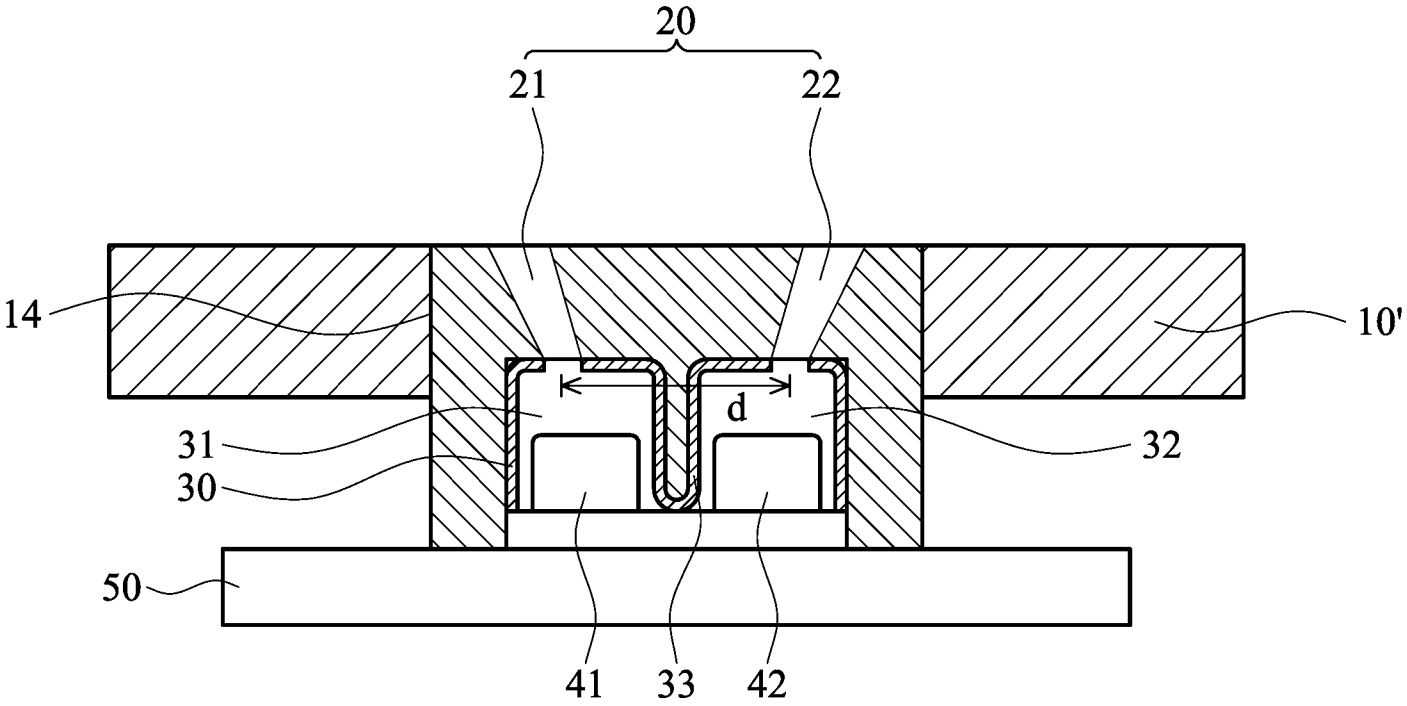

The acoustic boot 20 is detachably wedged in the wedging portion 13 (FIG. 1) or inserted into a through hole 18 of the case 10' (FIGS. 7A, 7B) by a rubber or acoustic plastic boot which can be tightly connected to the case 10. Therefore, the airtight of the acoustic paths is improved. The housing 30 can be made of metal or plastic or CMOS-MEMS package and the case 10 can be made of plastic or metal.

With reference to FIG. 1, the first duct 21 has a sound port 211 and a sound port 212, and the second duct 22 has a sound port 221 and a sound port 222. A protruding ring 216 surrounds the sound port 211. A protruding ring 226 surrounds the sound port 221. A protruding ring 217 surrounds the sound port 212. A protruding ring 227 surrounds the sound port 222. The protruding rings around the sound ports further improve the air tightness of the acoustic paths.

In this embodiment, the case 10 has an upper surface 16, and the first acoustic opening 11 and the second acoustic opening 12 are formed on the upper surface 16

Figure 3:
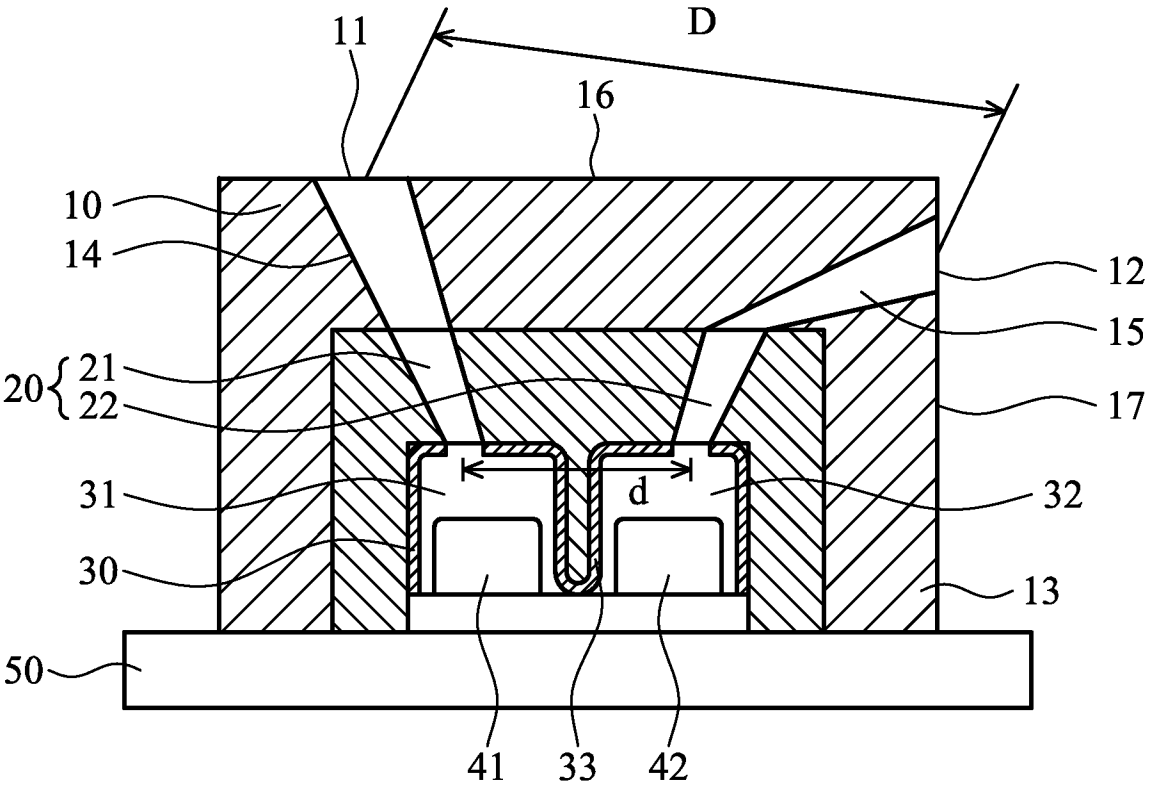
FIG. 3 shows the electronic device of a modified embodiment of the invention.

With reference to FIG. 3, in a modified embodiment, the case 10 has an upper surface 16 and a side surface 17, the upper surface 16 is perpendicular to the side surface 17, the first acoustic opening 11 is formed on the upper surface 16, and the second acoustic opening 12 is formed on the side surface 17.

With reference to FIGS. 1 and 2, the housing 30 comprises a first housing chamber 31, a second housing chamber 32 and an indentation portion 33. The first housing chamber 31 and the second housing chamber 32 are separated by the indentation portion 33, and the first microphone 41 and the second microphone 42 are respectively disposed in the first housing chamber 31 and the second housing chamber 32.

Figure 4:
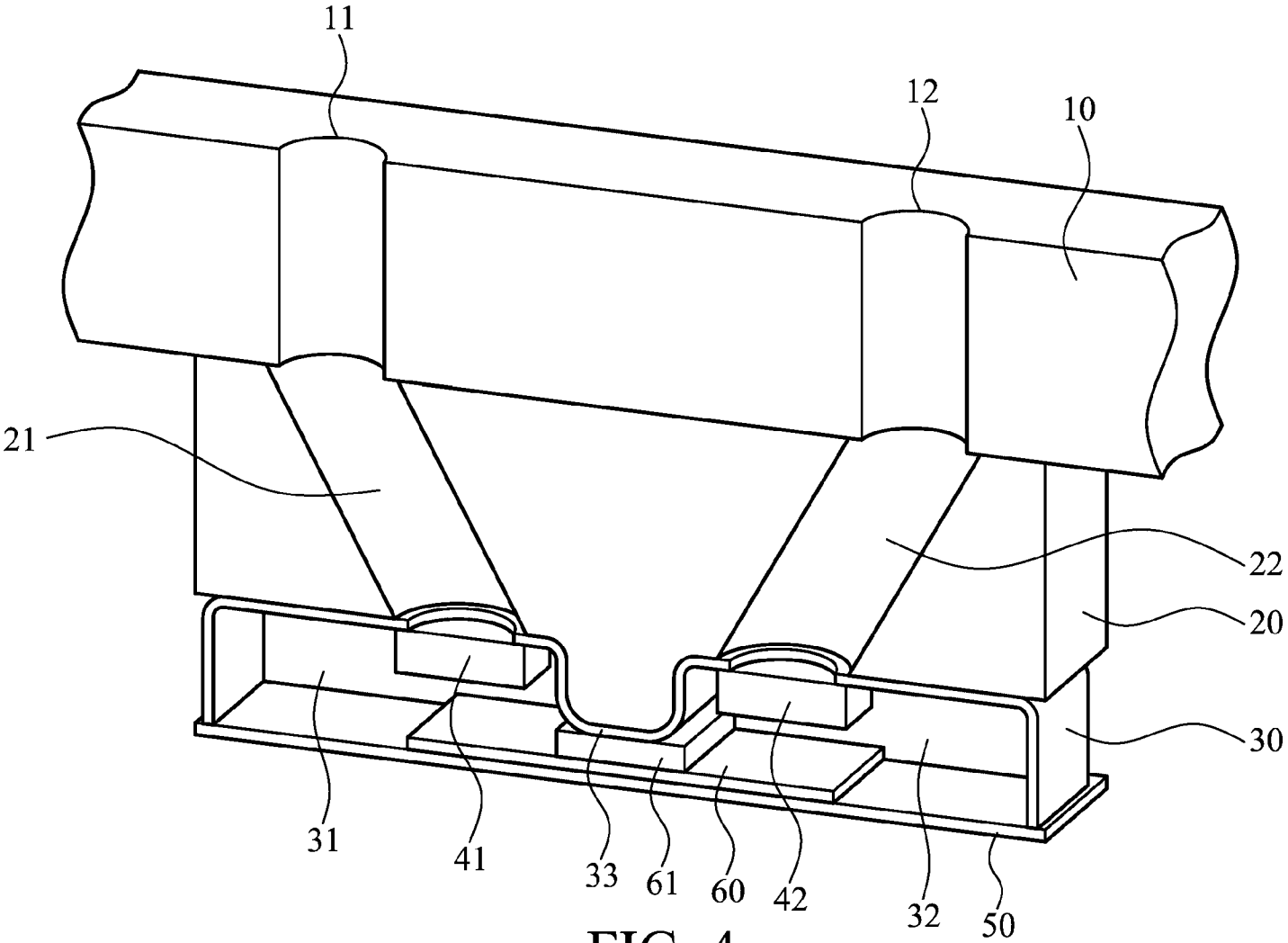
FIG. 4 shows the modified example of the invention, wherein the IC board is disposed in the case.

FIG. 4 shows a modified example of the invention, wherein an IC board 60 is disposed in the housing 30, the IC board 60 comprises an insulator 61 protruding therefrom, and the insulator 61 abuts the indentation portion 33 to acoustic isolate the first housing chamber 31 from the second housing chamber 32. A print circuit board 50 is disposed below the housing 30, wherein the IC board 60 is disposed on the print circuit board 50.

In one embodiment of the invention, the sound ports of the ducts may have a bigger or equal diameter compared with the opening on the case, in order to get sufficient sound energy. With reference to FIGS. 2 and 3, utilizing the embodiments of the invention, the microphone effective distance d can be increased to D by using a different direction of the ducts and the case. For example, in one embodiment, the length of the case ducts 14, 15 can be 4 mm, the height of the acoustic boot 20, 21 can be 1-2 mm, and the thickness of the housing can be 0.2 mm.

The electronic device can be a mobile phone, notebook, tablet or other portable electronic device. The electronic device can also be a television, computer or other electronic device.

Figure 5:
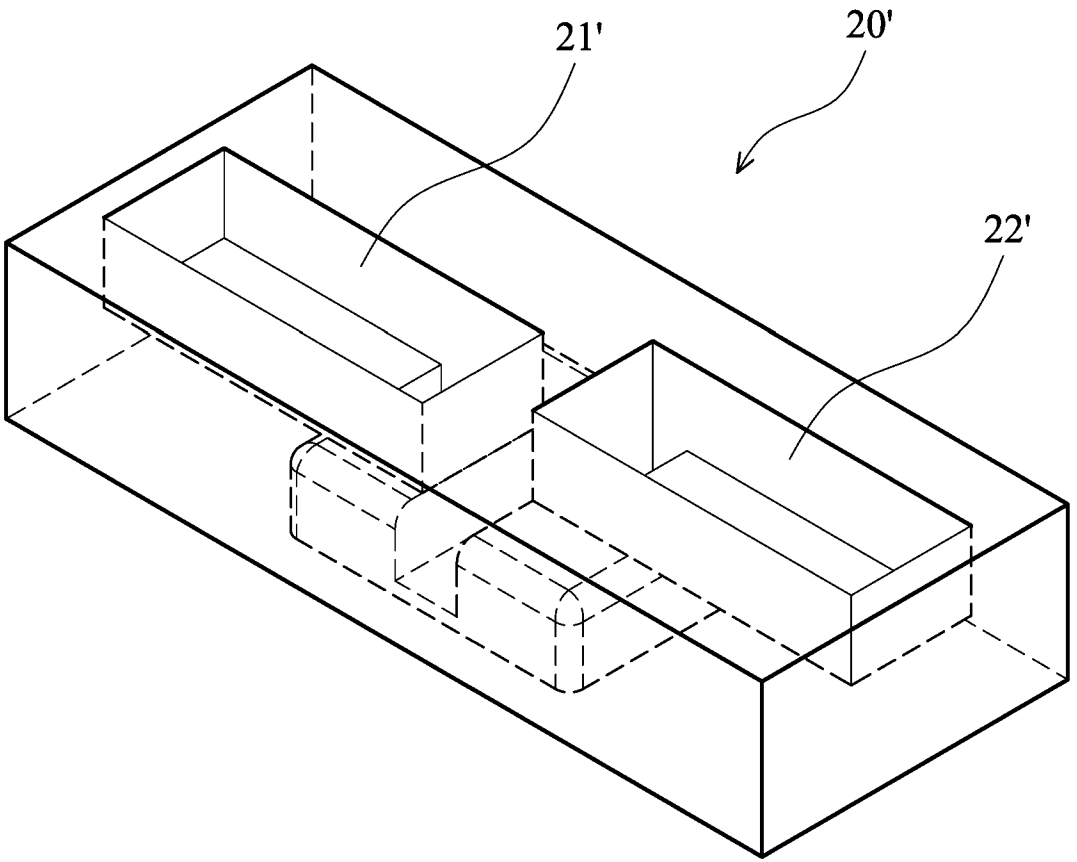
FIG. 5 shows the modified example of the invention, wherein the first duct and the second duct of the acoustic boot have rectangular cross-section.

FIG. 5 shows a modified example of the invention, wherein the first duct 21' and the second duct 22' of the boot 20' can have a rectangular cross-section. In one embodiment, an acoustic isolation block can be disposed between the first duct and the second duct to improve acoustic insulation.

Figure 6:
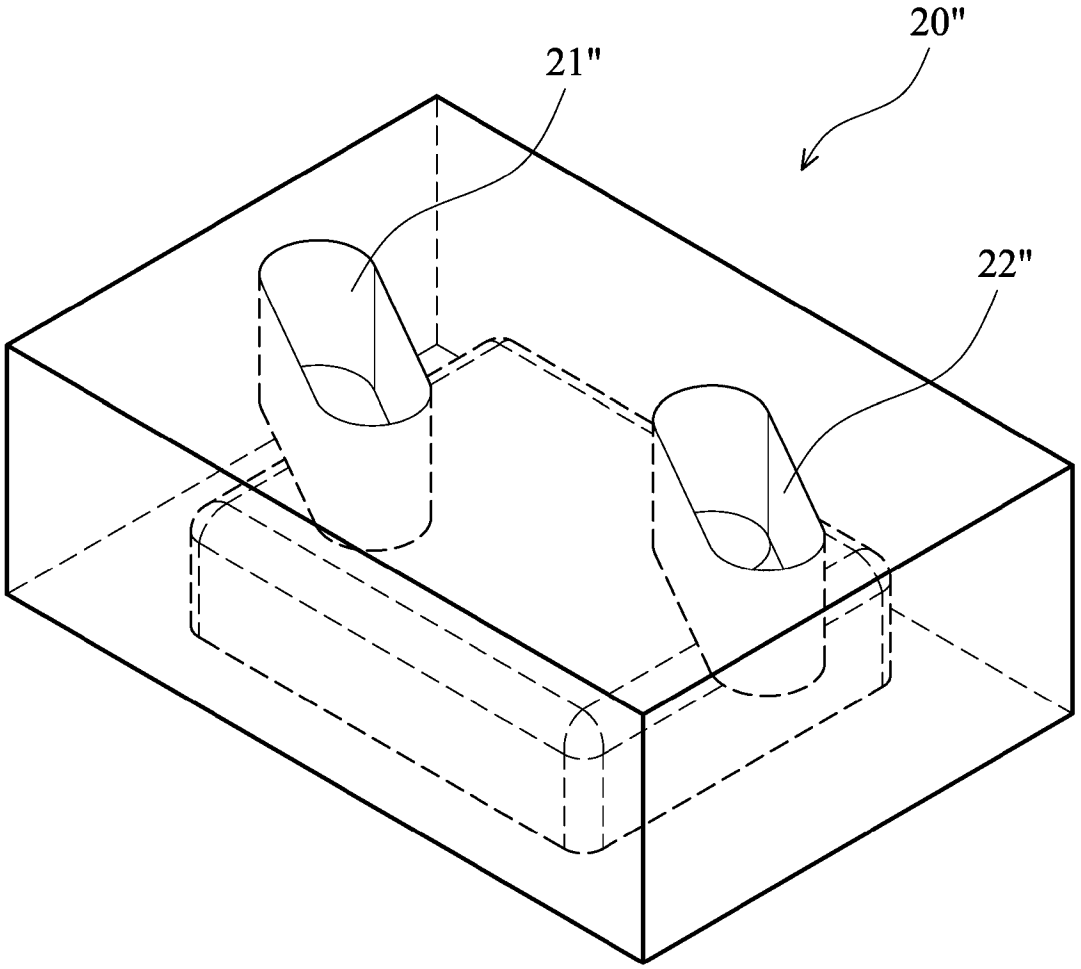
FIG. 6 shows the modified example of the invention, wherein the first duct and the second duct of the acoustic boot extend parallelly.

FIG. 6 shows a modified example of the invention, wherein the first duct 21" and the second duct 22" of the elastic boot 20" are extended in parallel.

Figure 8:
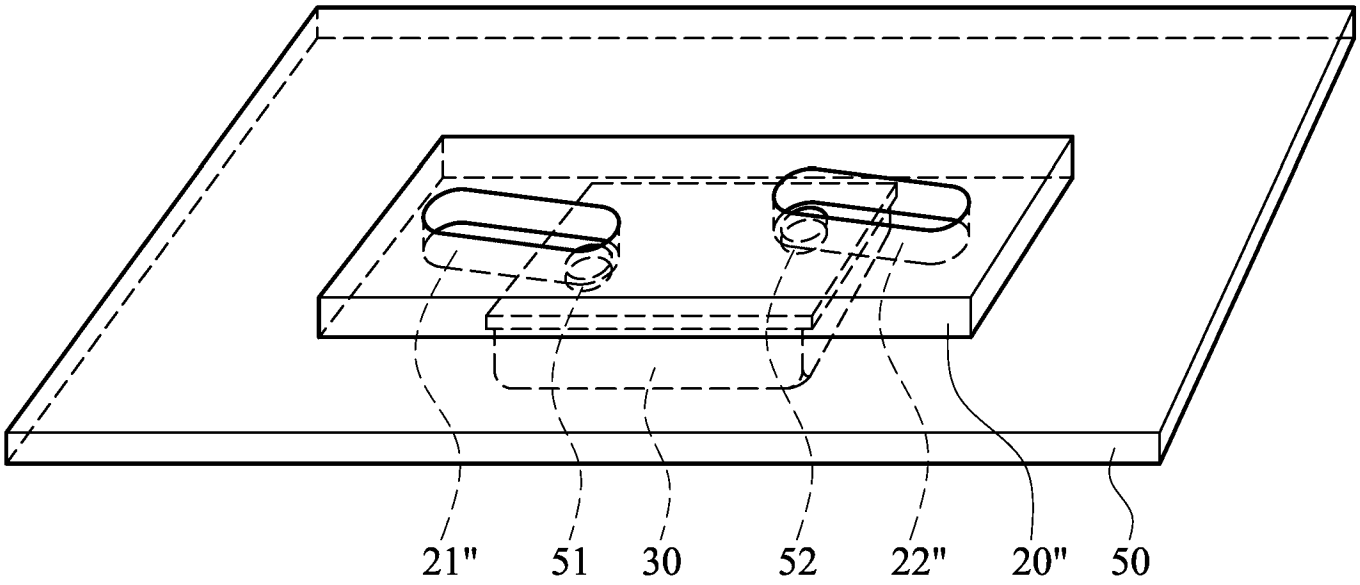
FIG. 8 shows a modified example of the embodiment of FIG. 6.

FIG. 8 shows a modified example of the embodiment of FIG. 6, wherein the print circuit board 50 comprises a first acoustic opening 51 and a second acoustic opening 52, the first duct 21" is connected to the first acoustic opening 51, and the second duct 22" is connected to the second acoustic opening 52.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a case, comprising a wedging portion, a first acoustic opening and a second acoustic opening;

an acoustic boot, wedged to the wedging portion, wherein the acoustic boot comprises a first recess, a second recess, a first extended duct and a second extended duct, wherein each duct comprises two sound ports, one located at each end of the each duct to communicate sound energy a microphone housing comprising a first sound inlet and a second sound inlet, covered by the acoustic boot, wherein the microphone housing comprises a first chamber and a second chamber, the first chamber is insulated from the second chamber, the first chamber is embedded in the first recess, and the second chamber is embedded in the second recess;

a first microphone, disposed in the first chamber; and a second microphone, disposed in the second chamber wherein sound energy enters the case through the first and second acoustic openings and communicates with the first and second microphones by way of the sound ports located on both opposite ends of the first and second ducts, forming an extended inlet distance for sound to reach the first and second microphones, respectively.

2. The electronic device as claimed in claim 1, wherein the electronic device further comprises a print circuit board, and the first microphone and the second microphone are disposed on the print circuit board.

3. The electronic device as claimed in claim 1, wherein the acoustic boot is detachably wedged to the case.

4. The electronic device as claimed in claim 1, wherein the acoustic boot is at the same surface of the case.

5. The electronic device as claimed in claim 1, wherein the acoustic boot further comprises a wall, integrally formed between the first chamber and the second chamber to separate the first microphone from the second microphone.

6. The electronic device as claimed in claim 1, wherein the first duct has a first inlet and first outlet, and the second duct has a second inlet and second outlet, and the acoustic boot comprises a plurality of protruding rings respectively formed around the first inlet and the second inlet.

7. The electronic device as claimed in claim 1, wherein the first duct has a first inlet and first outlet, and the second duct has a second inlet and second outlet, and a plurality of elastic material are used for airtight.

8. The electronic device as claimed in claim 1, wherein the first duct has a first inlet and first outlet, and the second duct has a second inlet and second outlet, and the acoustic boot comprises a plurality of protruding rings respectively formed around the first outlet and the second outlet.

9. The electronic device as claimed in claim 1, wherein the case further comprises a first case duct and a second case duct, the first case duct communicates the first acoustic opening to the first duct, and the second case duct communicates the second acoustic opening to the second duct.

10. The electronic device as claimed in claim 9, wherein the case has an upper surface, and the first acoustic opening and the second acoustic opening are formed on the upper surface.

11. The electronic device as claimed in claim 9, wherein the case has an upper surface and a side surface, and the upper surface is perpendicular to the side surface, the first acoustic opening is formed on the upper surface, and the second acoustic opening is formed on the side surface.

12. The electronic device as claimed in claim 1, wherein the microphone housing further comprises an indentation portion, and the first housing chamber and the second housing chamber inside the housing are separated by the indentation portion.

13. The electronic device as claimed in claim 12, further comprising an IC board, disposed in the housing, wherein the IC board comprises an insulator protruding therefrom, and the insulator abuts the indentation portion to insulate the first housing chamber from the second housing chamber.

14. The electronic device as claimed in claim 13, wherein the IC board is further integrated with the microphones using CMOS-MEMS Technology.

15. The electronic device as claimed in claim 13, further comprising a print circuit board, disposed below the housing, wherein the IC board is disposed on the print circuit board.

16. The electronic device as claimed in claim 12, wherein there is no indentation in the housing, but with an isolation wall inside the housing.

* * * * *